US009914305B2

(12) United States Patent
Orihara et al.

(10) Patent No.: US 9,914,305 B2
(45) Date of Patent: Mar. 13, 2018

(54) LIQUID STORAGE CONTAINER UNIT

(71) Applicant: CANON KABUSHIKI KAISHA, Tokyo (JP)

(72) Inventors: Tatsuaki Orihara, Tokyo (JP); Ryo Shimamura, Yokohama (JP); Akira Shiba, Machida (JP); Kazuya Yoshii, Yokohama (JP); Norihiro Ikebe, Kawasaki (JP); Takeho Miyashita, Yokohama (JP); Tomoki Yamamuro, Kawasaki (JP); Atsushi Arai, Yokohama (JP); Masatoshi Ohira, Fujisawa (JP); Hirofumi Okuhara, Tokyo (JP); Kazumasa Matsushita, Kawasaki (JP); Misato Furuya, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/479,816

(22) Filed: Apr. 5, 2017

(65) Prior Publication Data

US 2017/0305164 A1 Oct. 26, 2017

(30) Foreign Application Priority Data

Apr. 20, 2016 (JP) ..... 2016-084445

(51) Int. Cl.
*B41J 2/175* (2006.01)

(52) U.S. Cl.
CPC ..... *B41J 2/17523* (2013.01)

(58) Field of Classification Search
CPC B41J 2/17523; B41J 2/17563; B41J 2/17503; B41J 2/17566; B41J 2/17506; B41J 2/17509
See application file for complete search history.

(56) References Cited

U.S. PATENT DOCUMENTS

| | | | | |
|---|---|---|---|---|
| 5,162,817 | A | 11/1992 | Tajika et al. | 347/7 |
| 5,179,389 | A | 1/1993 | Arai et al. | 347/7 |
| 5,355,158 | A | 10/1994 | Inada et al. | 347/22 |
| 5,381,169 | A | 1/1995 | Arai et al. | 347/33 |

(Continued)

FOREIGN PATENT DOCUMENTS

JP H08-290577 11/1996

OTHER PUBLICATIONS

U.S. Appl. No. 15/590,762, filed May 9, 2017.

(Continued)

*Primary Examiner* — Juanita D Jackson
(74) *Attorney, Agent, or Firm* — Fitzpatrick, Cella, Harper & Scinto

(57) ABSTRACT

A liquid storage container unit according to the present invention includes: a liquid storage container provided with an opening; a plug which is attachable to and detachable from the opening and provided with a front edge to be inserted in the opening; and a support member which connects the plug and a member other than the plug and supports the plug, wherein the support member is molded into a shape with a curved portion and the front edge of the plug comes closer to the inner side surface of the curved portion of the support member in a state in which the plug is removed from the opening than in a state in which the plug is attached to the opening.

17 Claims, 11 Drawing Sheets

(56) References Cited

U.S. PATENT DOCUMENTS

| | | | | |
|---|---|---|---|---|
| 5,398,054 | A | 3/1995 | Fukazawa et al. | 347/33 |
| 5,534,898 | A | 7/1996 | Kashino et al. | 347/33 |
| 5,606,354 | A | 2/1997 | Bekki et al. | 347/33 |
| 5,646,655 | A | 7/1997 | Iwasaki et al. | 347/17 |
| 5,748,207 | A | 5/1998 | Inui et al. | 347/43 |
| 5,777,649 | A | 7/1998 | Otsuka et al. | 347/94 |
| 5,831,652 | A | 11/1998 | Hinami et al. | 347/86 |
| 5,980,021 | A | 11/1999 | Nagoshi et al. | 347/49 |
| 5,984,449 | A | 11/1999 | Tajika et al. | 347/15 |
| 5,988,783 | A | 11/1999 | Tajika et al. | 347/7 |
| 6,015,203 | A | 1/2000 | Arai et al. | 347/33 |
| 6,050,669 | A | 4/2000 | Yano et al. | 347/23 |
| 6,241,350 | B1 | 6/2001 | Otsuka et al. | 347/94 |
| 6,345,888 | B1 | 2/2002 | Matsumoto et al. | 347/86 |
| 6,402,308 | B1 | 6/2002 | Hattori et al. | 347/86 |
| 6,476,926 | B1 | 11/2002 | Yano et al. | 358/1.14 |
| 6,505,923 | B1 | 1/2003 | Yamamoto et al. | 347/85 |
| 6,719,395 | B2 | 4/2004 | Iwasaki et al. | 347/19 |
| 8,529,035 | B2 | 9/2013 | Tsukamoto et al. | 347/86 |
| 8,529,037 | B2 | 9/2013 | Miyashita et al. | 347/86 |
| 8,770,730 | B2 | 7/2014 | Nanjo et al. | 347/86 |
| 8,770,731 | B2 | 7/2014 | Miyashita et al. | 347/86 |
| 8,960,869 | B2 | 2/2015 | Takada et al. | 347/86 |
| 8,960,875 | B2 | 2/2015 | Shiba et al. | 347/93 |
| 9,016,842 | B2 | 4/2015 | Miyashita et al. | 347/86 |
| 9,139,012 | B2 | 9/2015 | Yamada et al. | B41J 2/17553 |
| 9,242,471 | B2 | 1/2016 | Yoneda et al. | B23P 19/027 |
| 9,278,540 | B2 | 3/2016 | Seki et al. | B41J 2/17513 |
| 9,375,938 | B2 | 6/2016 | Kondo et al. | B41J 2/17513 |
| 9,597,884 | B2 | 3/2017 | Nanjo et al. | B41J 2/17546 |
| 2011/0209335 | A1 | 9/2011 | Yamamoto et al. | 29/505 |
| 2015/0343793 | A1 | 12/2015 | Takada et al. | B41J 2/17556 |
| 2015/0352851 | A1 | 12/2015 | Shiba et al. | B41J 2/17513 |
| 2016/0089893 | A1* | 3/2016 | Osakabe | B41J 2/17513 347/85 |
| 2016/0200114 | A1 | 7/2016 | Nanjo et al. | B41J 2/17546 |
| 2016/0347078 | A1 | 12/2016 | Kato et al. | B41J 2/175 |
| 2017/0087863 | A1 | 3/2017 | Miyashita et al. | B41J 2/17553 |
| 2017/0096010 | A1 | 4/2017 | Nanjo et al. | B41J 2/17546 |
| 2017/0120606 | A1 | 5/2017 | Koshikawa et al. | B41J 2/1754 |
| 2017/0120613 | A1 | 5/2017 | Ikebe et al. | B41J 2/17553 |

OTHER PUBLICATIONS

U.S. Appl. No. 15/332,604, filed Oct. 24, 2016.
U.S. Appl. No. 15/338,031, filed Oct. 28, 2016.
U.S. Appl. No. 15/353,238, filed Nov. 16, 2016.
U.S. Appl. No. 15/489,437, filed Apr. 17, 2017.
U.S. Appl. No. 15/489,445, filed Apr. 5, 2017.
U.S. Appl. No. 15/603,131, filed May 23, 2017.
U.S. Appl. No. 15/625,960, filed Jun. 16, 2017.

* cited by examiner

LIQUID STORAGE CONTAINER UNIT

BACKGROUND OF THE INVENTION

Field of the Invention

The present invention relates to a liquid storage container unit used with a liquid discharge device or the like.

Description of the Related Art

A liquid discharge device adapted to discharge a liquid to a recording medium or the like requires the replenishment of a liquid to be discharged. In many cases, a liquid is replenished by a method in which a whole cartridge type liquid storage container is replaced by a cartridge type liquid storage container pre-filled with the liquid. Meanwhile, there has been adopted a configuration that enables a liquid to be injected into a liquid storage container attached to a liquid discharge device so as to gain advantages, such as a reduction in running cost.

Regarding an ink jet recording device, which is an example of a liquid discharge device, Japanese Patent Application Laid-Open No. H08-290577 discloses a liquid storage container (ink tank) which is provided in the main body of a recording device and which can be repeatedly used by replenishing an ink, which is a liquid used for recording. The ink tank described in Japanese Patent Application Laid-Open No. H08-290577 has an ink injection port, through which an ink is replenished by a dropper type infusion container or the like. Further, the ink injection port of the ink tank is adapted to be plugged by a lid with a lock except when the ink is replenished, thus preventing the ink from leaking or drying. The lid is connected to the main body of the ink tank through a hinge.

According to the configuration disclosed in Japanese Patent Application Laid-Open No. H08-290577, a portion of the lid that is the front edge of a plug, which is inserted into an ink supply port, and the neighborhood of the portion are located at a position where the front edge and the neighborhood thereof easily come in contact with a hand of an operator replenishing an ink or an infusion container used for replenishing the ink when replenishing the ink, and are exposed facing toward the ink supply port. The portion that is the front edge of the plug and the neighborhood thereof are located at the position prone to be smeared by an ink, so that a hand of the operator or an infusion container may be smeared by the contact with the portion and the neighborhood thereof when replenishing the ink. This problem is not peculiar to an ink tank provided in an ink jet recording device, but generally encountered in a liquid storage container which is provided in a liquid discharge device and enables the replenishment of a liquid.

SUMMARY OF THE INVENTION

The present invention is directed to providing a liquid storage container unit which is provided in a liquid discharge device or the like, includes a liquid storage container capable of replenishing a liquid, and minimizes the possibility of smearing an operator's hand or an infusion container when refilling the liquid storage container with a liquid.

The liquid storage container unit according to the present invention includes: a liquid storage container provided with an opening; a plug which is attachable to and detachable from the opening and provided with a front edge to be inserted in the opening; and a support member which connects the plug and a member other than the plug and supports the plug, wherein the support member is shaped to have a curved portion, and the front edge of the plug moves closer to an inner side surface of the curved portion of the support member in a state in which the plug is detached from the opening than in a state in which the plug is attached to the opening.

Further features of the present invention will become apparent from the following description of exemplary embodiments with reference to the attached drawings.

DESCRIPTION OF THE EMBODIMENTS

Preferred embodiments of the present invention will now be described with reference to the accompanying drawings. Before describing the liquid storage container units based on the present invention, a liquid discharge device provided with a liquid storage container will be first described with reference to FIG. 1.

The following description will be given on the assumption that the liquid discharge device is an ink jet recording device, which is a typical example thereof. Understandably, however, the liquid discharge device to which the liquid storage container unit according to the present invention can be applied is not limited to an ink jet recording device. An ink jet recording device is a device adapted to discharge a recording liquid to perform recording on a recording medium, and can be applied to office equipment, such as a printer, a copier, and a facsimile machine, and an industrial manufacturing machine and the like. By using an ink jet recording device, recording can be accomplished on a variety of recording media, such as paper, thread, fiber, cloth, leather, plastics, glass, wood, and ceramics. The term "recording liquid" used herein is to be interpreted in a broad sense, and the term means a liquid supplied onto a recording medium thereby to form an image, a design, a pattern and the like, to process a recording medium, or to perform treatment on a recording liquid or a recording medium.

Figure 1:
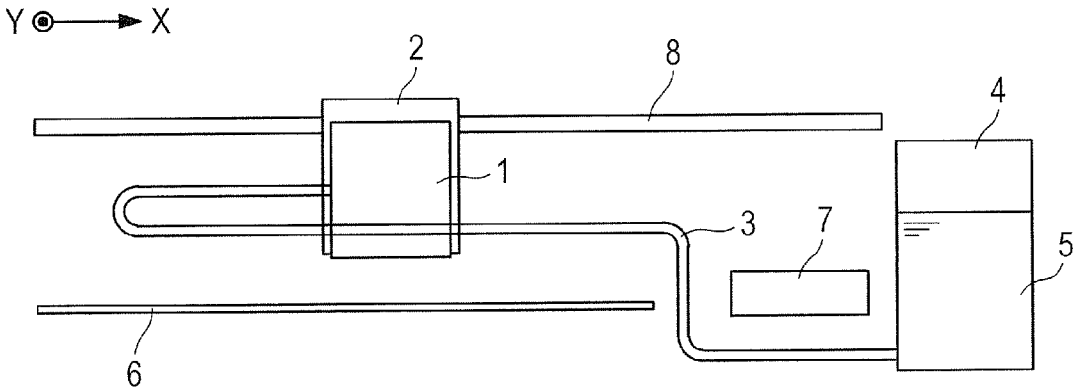
FIG. 1 is a schematic diagram illustrating the configuration of a liquid discharge device.

The liquid discharge device illustrated in FIG. 1 is configured as the ink jet recording device that performs recording on a recording medium 6. The liquid discharge device is a so-called serial type device, which intermittently carries a recording medium 6 by a conveying roller (not illustrated) in a Y-direction illustrated in the drawing and performs reciprocal scanning of a liquid discharge head 1 mounted on a carriage 2 in an X-direction so as to carry out recording. The Y-direction is called also a sub-scanning direction, and the X-direction is in the direction orthogonal to the Y-direction and called also a main scanning direction. The liquid discharge head 1 has a plurality of discharge ports (not illustrated) for discharging a liquid, such as a recording liquid, toward the recording medium 6. The carriage 2 is movably supported along a guide rail 8 disposed along the X direction and fixed to an endless belt (not illustrated) that moves in parallel to the guide rail 8. The endless belt is reciprocated by a driving force of a carriage motor (not illustrated) thereby to perform the reciprocal scanning of the carriage 2 on the guide rail 8 in the X direction.

In order to supply a liquid to be discharged, such as a recording liquid, to the liquid discharge head 1, the liquid discharge head 1 is connected to a liquid storage container 4 by a supply tube 3 made of a soft material. A liquid 5 stored in the liquid storage container 4 is supplied to the liquid discharge head 1 through the supply tube 3. Further, in order to recover and maintain the discharge condition of the liquid from the liquid discharge head 1, a recovery processing unit 7 is provided, which has a capping mechanism capable of covering the discharge ports of the liquid discharge head 1 and a pumping mechanism capable of drawing in the liquid 5 from the discharge ports through a cap.

Figure 2:
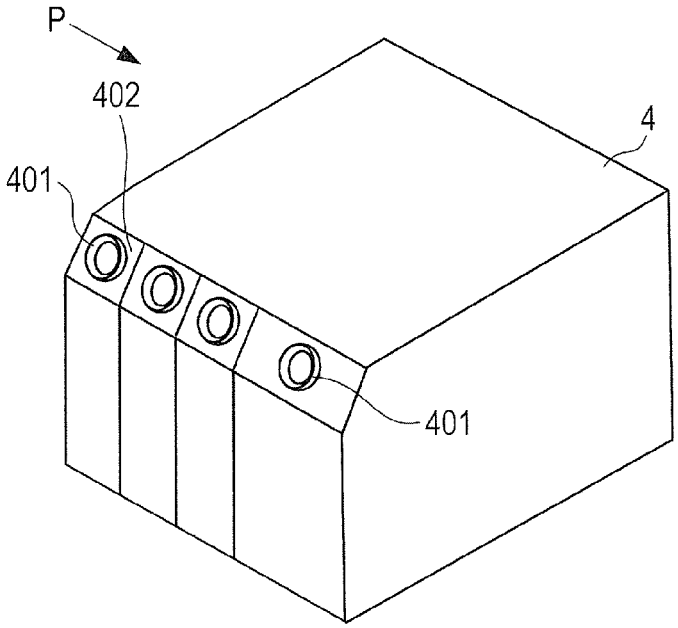
FIG. 2 is a perspective view illustrating the appearance of a liquid storage container.

FIG. 2 illustrates an example of a typical liquid storage container 4 provided in a liquid discharge device, which is an ink jet recording device. In this case, the interior of the liquid storage container 4 is partitioned into four spaces to separately hold the recording liquids of, for example, four colors (yellow, magenta, cyan, and black recording liquids), and each of the spaces is provided with an injection port 401 (opening) leading to the space. The liquid storage container 4 is formed to be a substantially rectangular parallelepiped as a whole, and a part near the top surface is cut off along one side thereof to form a sloping surface 402 that connects to the top surface. The injection ports 401 are formed in the sloping surface 402. Each of the injection ports 401 is an opening that is in communication with the interior of the liquid storage container 4, so that the front edge of a dropper type infusion container with a liquid therein is inserted into the injection port 401, thereby enabling the liquid storage container 4 to be refilled with a desired liquid, as will be discussed hereinafter.

In order to prevent a liquid from leaking out of the liquid storage container 4, the injection ports 401 are hermetically sealed by plugs fitted therein except when replenishing a liquid. In other words, the plugs have front edges to be inserted into the injection ports 401 and are configured to be attachable to and detachable from the injection ports 401. The plugs are detached from the injection ports 401 at the time of an injection operation, and the plugs are preferably connected to the liquid storage container 4 by some means to prevent, for example, the loss of the detached plugs. Further, the front edges of the plugs are inserted into the liquid storage container 4 through the injection ports 401, so that the front edges of the plugs and the peripheral area thereof are frequently smeared by liquids in the liquid storage container 4 or liquids attached to the injection ports 401. The liquid storage container unit according to the present invention is configured such that the plugs are connected to the liquid storage container 4 by support members and that the plugs can be detached from the injection ports 401 and held without the front edges thereof touching a user or an infusion container 9 at the time of the injection operation. The support members are molded components made of, for example, an elastic material, such as rubber, and therefore elastically support the plugs detached from the injection ports 401. Preferably, the plugs and the support members are integrally molded. The postures of the plugs detached from the injection ports 401 depend mainly on the shapes of the plugs and the support members and the deformation thereof caused by their weights unless the detached plugs are fixed. In the liquid storage container unit, the support members are configured to support the plugs at such postures as to minimize the possibility of coming into contact with the hands of an operator replenishing a liquid or an infusion container used for the replenishment when the liquid is replenished. More specifically, the support members are formed such that the plugs take such postures or certain means are provided to maintain such postures of the plugs after the plugs are detached from the injection ports 401 to perform the injection operation.

The configurations of the support members are not limited to those adapted to be connected to the liquid storage container 4. The support members may be connected to members separate from the plugs, and may be connected to, for example, the main body of the liquid discharge device.

In other words, in the liquid storage container unit according to the present invention, the plug can take at least a first state, in which the plug closes the injection port 401, and a second state, in which the plug opens the injection port 401 for the injection of a liquid and then stands by. In the second state, the plug takes such a posture as to minimize the possibility of the front edge thereof accidentally coming into contact with the hand of an operator or the infusion container used for the replenishment. Specifically, such a posture includes, for example, the front edge of the plug being oriented in a direction toward the support member or the plug being located between the position at which the support member connects to the liquid storage container and the injection port in a state in which no force is being applied to the plug.

The following will describe the liquid storage container unit according to the present invention in connection with specific embodiments. However, the dimensions, the materials, the shapes and the relative arrangements and the like of the constituent components in the examples described below are to be changed as appropriate according to the configuration or various conditions of each device, and it is to be understood that the present invention is not limited thereto.

First Embodiment

Figure 3A:
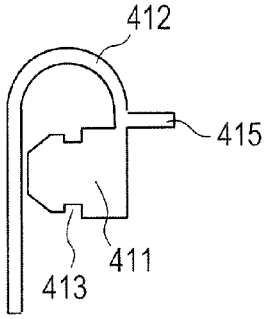
FIGS. 3A, 3B, 3C, and 3D provide diagrams illustrating a liquid storage container unit according to a first embodiment of the present invention.
Figure 3B:
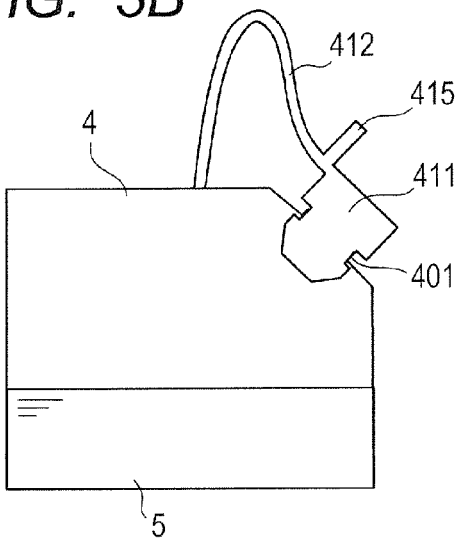
Figure 3C:
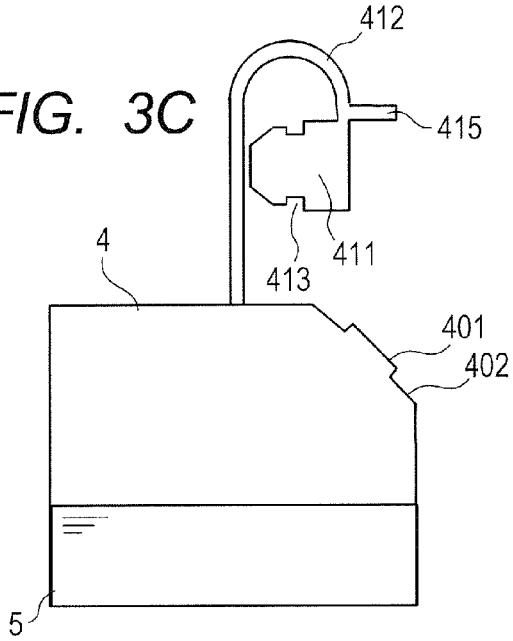
Figure 3D:
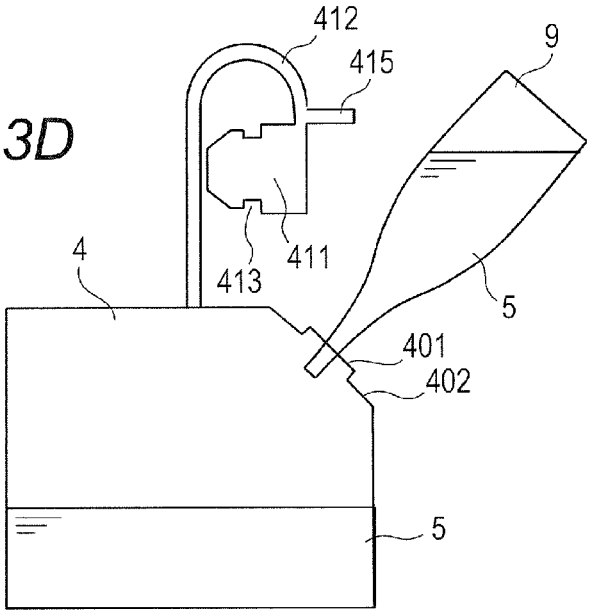

FIG. 3A to FIG. 3D illustrate a liquid storage container unit according to a first embodiment. FIG. 3A is a schematic sectional view illustrating a plug 411 and a support member 412, which are integrally formed, FIG. 3B illustrates a state in which an injection port 401 is closed with the plug 411, and FIG. 3C illustrates a state in which the plug 411 has been detached from the injection port 401. Further, FIG. 3D illustrates a state in which the front edge of the infusion container 9 has been inserted into the injection port 401 to fill the liquid storage container 4 with the liquid 5. All of FIG. 3B to FIG. 3D are sectional diagrams illustrating the liquid storage container 4 observed from the direction indicated by an arrow P in FIG. 2.

As illustrated in FIG. 3A, the plug 411 and the support member 412 are integrally formed using an elastic material, such as rubber. The support member 412 is formed to have a shape with a curvature, such as an inverse U shape, when no force is applied thereto. One end of the U shape is provided with the plug 411, while the other end serving as a fixed end directly extends to connect to the top surface of the liquid storage container 4 (refer to FIG. 3C). The plug 411 is adapted to close the injection port 401 of the liquid storage container 4 and is formed to have a substantially columnar shape with a tapered front edge. The side surface of the plug 411 has a circumferential groove 413 that fits in the injection port 401. If adequate fitting between the plug 411 and the injection port 401 can be secured, then the circumferential groove 413 is not necessarily required to be provided. When the plug 411 is fitted in the injection port 401, i.e. when the plug 411 is in the first state, the region from the circumferential groove 413 to the front edge is positioned inside the liquid storage container 4, as illustrated in FIG. 3B. This region adjacent to the front edge of the plug 411 tends to be smeared by the liquid 5 in the liquid storage container 4 or by the liquid 5 adhering to the vicinity of the injection port 401 when injecting the liquid 5. The support member 412 is connected to the plug 411 at the position of the base of the plug 411, and at this position, a lug 415 held by an operator when handling the plug 411 is provided. In the present embodiment, the state in which the plug 411 has been detached from the injection port 401 and the plug 411 is being subjected to no force except a gravitational force as illustrated in FIG. 3C, corresponds to the second state, in which the plug is standing by during the injection operation. At this time, the front edge of the plug 411 faces toward the inner side of the support member 412. The inner side of the support member 412 herein employed refers to the inner side surface of the curvature, i.e. the inner side surface of the U shape in the support member 412 having the inverse U-shaped curvature.

In the liquid storage container unit according to the present embodiment, when closing the injection port 401 by the plug 411, the support member 412 is stretched from its original shape as illustrated in FIG. 3B. In contrast to this, when the plug 411 is removed from the injection port 401, the support member 412 regains its original shape and the front edge of the plug 411 faces toward the inner side of the support member 412, as illustrated in FIG. 3C. The operator can hold the lug 415 to move the plug 411 to close the injection port 401 by the plug 411 or detach the plug 411 from the injection port 401. FIG. 3D illustrates the state in which the liquid 5 is being injected into the liquid storage container 4 by the infusion container 9. The front edge of the plug 411 is facing the inner side of the support member 412 and not exposed facing toward the injection port 401. This minimizes the possibility of a hand of the operator or the infusion container 9 being smeared by the liquid attached to the plug 411 when performing the injection operation. Further, according to the present embodiment, when the plug 411 is detached from the injection port 401, the plug 411 is positioned closer to the center of the top surface of the liquid storage container 4 than the injection port 401.

Further, in the liquid storage container unit according to the present embodiment, in the state in which the plug 411 has been detached from the injection port 401 as illustrated in FIG. 3C, the front edge of the plug 411 is closer to the inner side surface of the support member 412 than in the state in which the plug 411 has been attached to the injection port 401 as illustrated in FIG. 3B. This minimizes the possibility of a hand of the operator or the infusion container 9 being smeared by the liquid attached to the plug 411 when the injection operation is performed. Further, in the liquid storage container unit according to the present embodiment, in the state in which the plug 411 has been detached from the injection port 401 as illustrated in FIG. 3C, the front edge of the plug 411 faces toward the inner side surface of the support member 412. The meaning of the phrase "faces toward the inner side surface of the support member" is not limited to the state in which the front edge of the plug and the inner side surface of the support member face each other in parallel, and any other states may be applied insofar as the inner angle formed by the front edge of the plug and the inner side surface of the support member is smaller than 90 degrees. As described above, the front edge of the plug 411 faces toward the inner side surface of the support member 412 and is not exposed facing toward the injection port 401, thus making it possible to further reduce the possibility of the liquid attached to the plug 411 smearing an operator's hand or the infusion container 9 when the injection operation is performed.

Even if accidental contact with the front edge of the plug 411 happens, causing the inner side of the support member 412 to be smeared by the liquid 5, the occurrence of secondary smearing can be prevented, since the presence of the plug 411 makes the inner side of the support member 412 inaccessible to an operator's hand. The embodiments described below share similarity with the first embodiment in that the portions that could be smeared by the contact with the front edge of the plug are configured to be inaccessible to an operator's hand, thus leading to the possibility of preventing the occurrence of secondary smearing.

Comparative Example

Figure 4A:
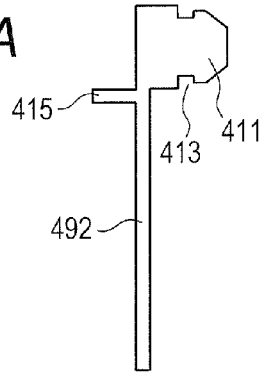
FIGS. 4A, 4B, 4C, and 4D provide diagrams illustrating a liquid storage container unit according to a comparative example.
Figure 4B:
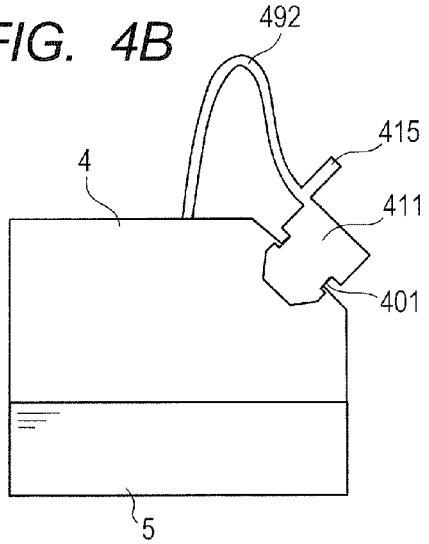
Figure 4C:
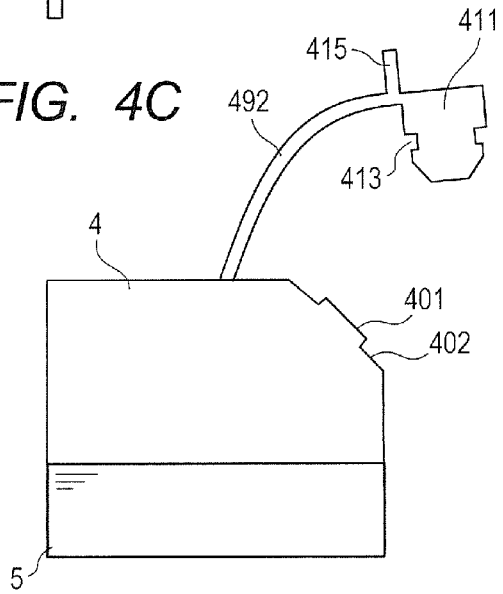
Figure 4D:
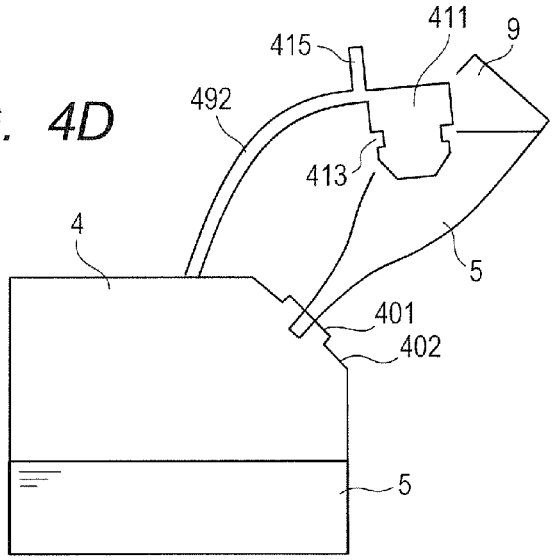

In order to further clearly indicate the effect of the liquid storage container unit according to the first embodiment, a liquid storage container unit not based on the present invention will be described with reference to FIG. 4A to FIG. 4D. The liquid storage container unit illustrated in FIG. 4A to FIG. 4D is the same as that of the first embodiment with the exception that a support member 492, which is molded integrally with a plug 411 and connected to a liquid storage container 4, remains in a linear shape when no force is applied thereto. FIG. 4A to FIG. 4D correspond to FIG. 3A to FIG. 3D illustrating the liquid storage container unit according to the first embodiment. When closing an injection port 401 by the plug 411, the support member 492 is bent from its original shape, as illustrated in FIG. 4B. Meanwhile, when the plug 411 is removed from the injection port 401, the support member 492 stretches back substantially linearly due to the elastic force thereof, but the front edge hangs downward because of the mass of the plug 411, as illustrated in FIG. 4C. As a result, the front edge portion of the plug 411 will face the outside of the liquid storage container 4, as observed from the injection port 401, and will be exposed facing downward at an obliquely upper position. The position of the plug 411 is the position where the plug 411 interferes with an infusion container 9 or an operator's hand when a liquid 5 is injected into a liquid storage container 4, as illustrated in FIG. 4D, thus leading to the tendency of smearing an operator's hand or the infusion container 9 in the comparative example when the injection operation is performed.

Second Embodiment

Figure 5A:
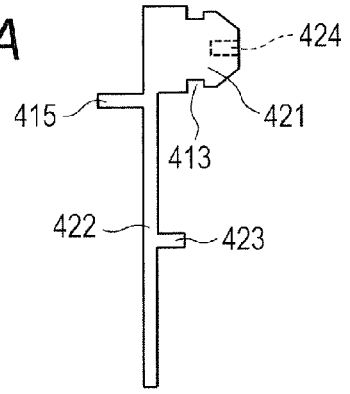
FIGS. 5A, 5B, 5C, and 5D provide diagrams illustrating a liquid storage container unit according to a second embodiment.
Figure 5B:
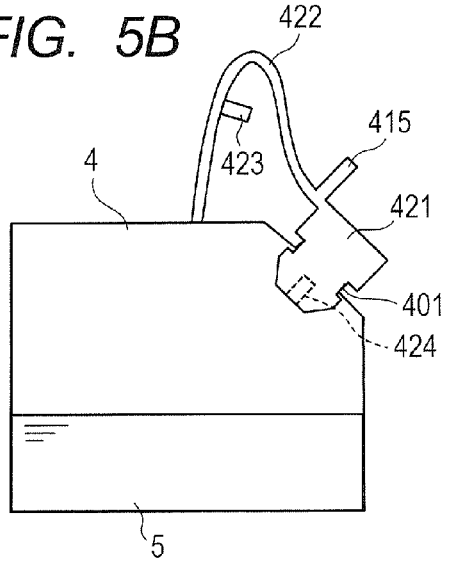
Figure 5C:
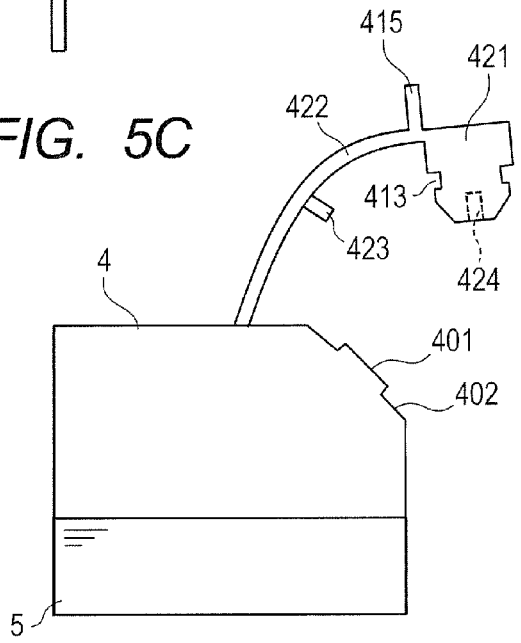
Figure 5D:
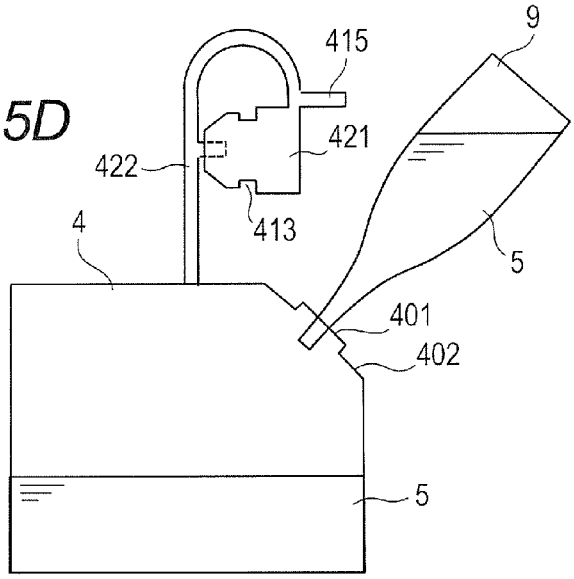

In the first embodiment described above, the support member 412 is molded to have the inverse U shape when no force is applied thereto. However, even if a linear support member is used, the liquid storage container unit according to the present invention can be configured. FIG. 5A to FIG. 5D illustrate a liquid storage container unit according to a second embodiment. FIG. 5A to FIG. 5D correspond to FIG. 3A to FIG. 3D illustrating the liquid storage container unit according to the first embodiment. The second embodiment uses a plug 421, which is the same as the plug 411 in the first embodiment with the exception that the plug 421 is provided with a recess 424 like a boss hole formed at the center of the front edge, as illustrated in FIG. 5A. The plug 421 is molded integrally with a support member 422, which is linearly formed, and connected to the top surface of a liquid storage container 4 through the support member 422. The central portion on the inner side of the support member 422 is provided with a boss-shaped protrusion 423 that can be fitted to the recess 424 of the plug 421. When an injection port 401 is closed by the plug 421, the support member 422 is bent from its original shape, as illustrated in FIG. 5B. In the present embodiment, as illustrated in FIG. 5D, when the plug 421 is removed, the recess 424 of the plug 421 is fitted onto the protrusion 423 of the support member 422, thus enabling the plug 421 to be fixed to the support member 422, the front edge of the plug 421 being oriented toward the inner side of the support member 422. In other words, the plug 411 is configured to be fixable to a part of the support member 422, which is a part separate from the injection port 401. The state illustrated in FIG. 5D is the second state in which the plug is standing by during the injection operation. At this time, as with the first embodiment, the plug 421 is positioned closer to the center of the top surface of the liquid storage container 4 than the injection port 401. In the present embodiment also, the front edge of the plug 421 is not exposed facing toward the injection port 401 when the plug 421 is detached and fixed to the support member 422, as illustrated in FIG. 5D, so that the front edge of the plug 421 can be made inaccessible to an operator's hand or the infusion container 9. This minimizes the possibility of an operator's hand or the infusion container 9 being smeared by a liquid attached to the plug 421 when the injection operation is performed.

Further, in the liquid storage container unit according to the present embodiment, the support member 422 is bent when the front edge of the plug 421 is fixed to the support member 422, as illustrated in FIG. 5D. In this state, the front edge of the plug 421 is closer to the inner side of the support member 422 than in the state in which the plug 421 has been attached to the injection port 401 as illustrated in FIG. 5B. This minimizes the possibility of an operator's hand or the infusion container 9 being smeared by a liquid attached to the plug 421 when the injection operation is performed. Further, in the liquid storage container unit according to the present embodiment, the front edge of the plug 421 faces toward the inner side surface of the support member 422 in the state in which the front edge of the plug 421 is fixed to the support member 422, as illustrated in FIG. 5D. The meaning of the phrase "faces toward the inner side surface of the support member" is not limited to the state in which the front edge of the plug and the inner side surface of the support member face each other in parallel, and any other states may be applied insofar as the inner angle formed by the front edge of the plug and the inner side surface of the support member is smaller than 90 degrees. As described above, the front edge of the plug 421 faces toward the inner side surface of the support member 422 and is not exposed facing toward the injection port 401, thus making it possible to further reduce the possibility of the liquid attached to the plug 421 smearing an operator's hand or the infusion container 9 when the injection operation is performed.

Third Embodiment

Figure 6A:
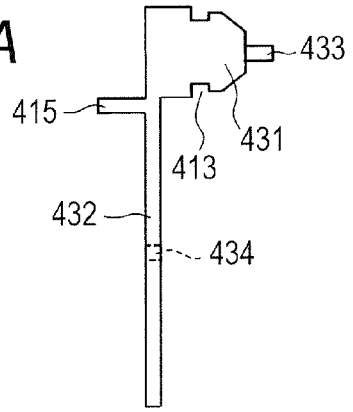
FIGS. 6A, 6B, 6C, and 6D provide diagrams illustrating a liquid storage container unit according to a third embodiment.
Figure 6B:
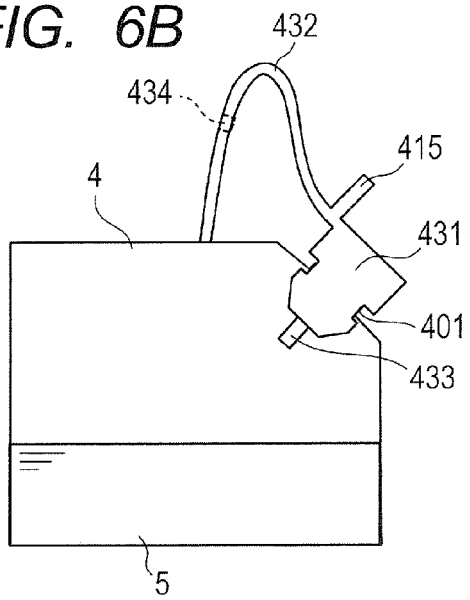
Figure 6C:
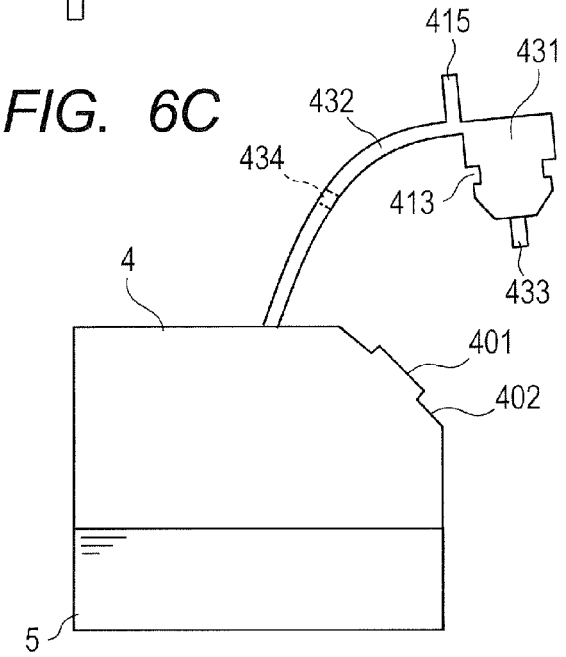
Figure 6D:
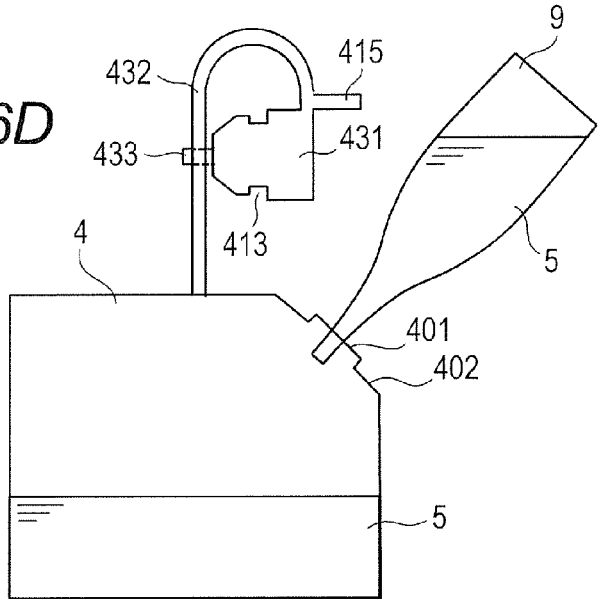
Figure 7A:
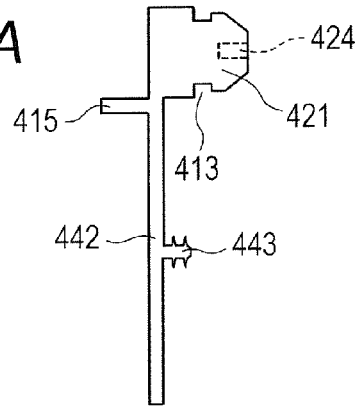
FIGS. 7A, 7B, 7C, and 7D provide diagrams illustrating a liquid storage container unit according to a fourth embodiment.
Figure 7B:
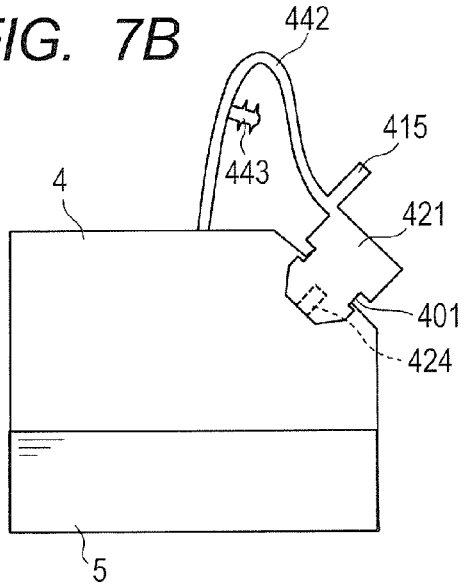
Figure 7C:
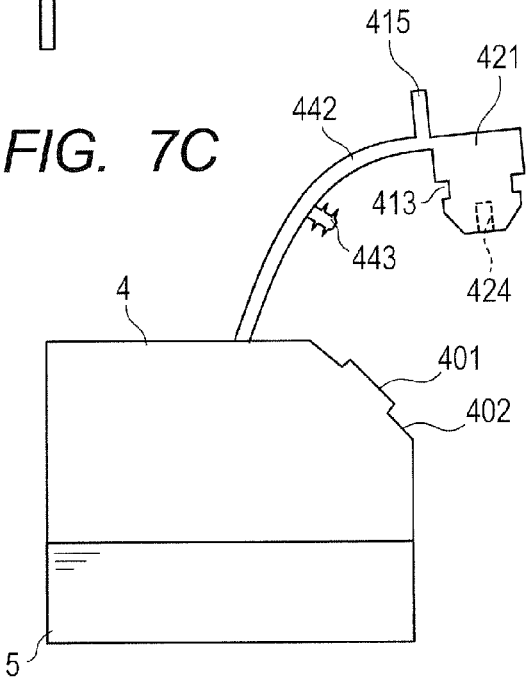
Figure 7D:
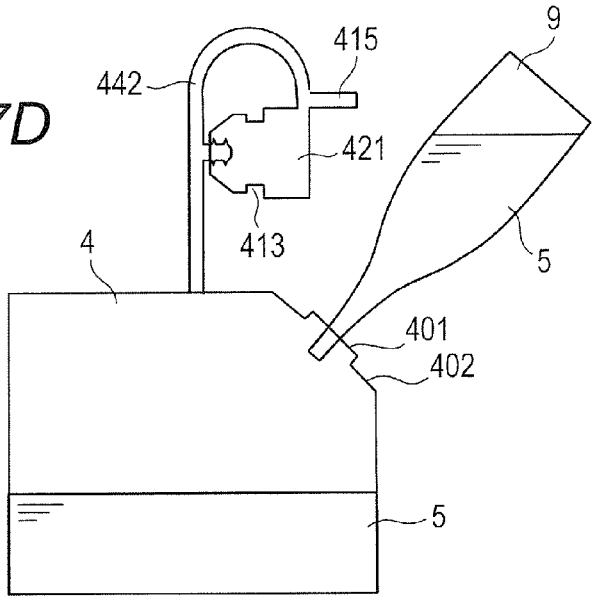

FIG. 6A to FIG. 6D illustrate a liquid storage container unit according to a third embodiment. FIG. 6A to FIG. 6D correspond to FIG. 3A to FIG. 3D illustrating the liquid storage container unit according to the first embodiment. As with the second embodiment, the third embodiment also uses a linear support member 432. Unlike the one in the second embodiment, however, the support member 432 has a hole like a boss hole or a recess 434 at the center of the inner side thereof, as illustrated in FIG. 6A. A boss-shaped protrusion 433 that matches the hole or the recess 434 is provided at the center of the front edge of a plug 431 formed integrally with the support member 432. When an injection port 401 is closed by the plug 431, the support member 432 is bent from its original shape, as illustrated in FIG. 6B. In the present embodiment, as illustrated in FIG. 6C, when the plug 431 is removed, the protrusion 433 of the plug 431 is fitted in the recess 434 of the support member 432, thereby enabling the plug 431 to be fixed to the support member 432, with the front edge of the plug 431 facing the inner side of the support member 432. As with the second embodiment, in the present embodiment also, the front edge of the plug 431 can be made inaccessible to an operator's hand or an infusion container 9 when the plug 431 is removed, as illustrated in FIG. 6D. This minimizes the possibility of an operator's hand or the infusion container 9 being smeared by a liquid attached to the plug 431 when the injection operation is performed.

The purport of the second and the third embodiments is to enable the plug to be fixed to the support member while preventing the front edge of the plug from being exposed. Hence, the recess and the protrusion, which fit each other, may be provided in reverse positions, as indicated in the second and the third embodiments, or the front edge of the plug may be fixed to the support member by a mechanism, such as a hook or a free stop rather than fitting. In other words, according to the second and the third embodiments, in order to fix the plug to the support member, a first structure is formed on the front edge of the plug and a second structure is formed on the support member, and the first structure and the second structure are adapted to be fittable or engageable with each other.

Fourth Embodiment

FIG. 7A to FIG. 7D illustrate a liquid storage container unit according to a fourth embodiment. FIG. 7A to FIG. 7D correspond to FIG. 5A to FIG. 5D illustrating the liquid storage container unit according to the second embodiment. The liquid storage container unit according to the fourth embodiment is the same as the one according to the second embodiment with the exception that unevenness is formed on the side surface of a boss-shaped protrusion 443 provided on the inner side of a support member 442 integrally formed with a plug 421. According to the fourth embodiment, the unevenness on the side surface of the protrusion 443 enables the plug 421 to be further firmly fixed, thus reducing the possibility of the plug 421 coming off due to the elasticity of the support member 442. This minimizes the possibility of accidental smearing of an operator's hand or an infusion container 9.

Fifth Embodiment

Figure 8A:
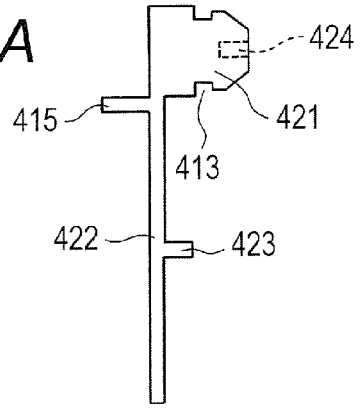
FIGS. 8A, 8B, 8C, and 8D provide diagrams illustrating a liquid storage container unit according to a fifth embodiment.
Figure 8B:
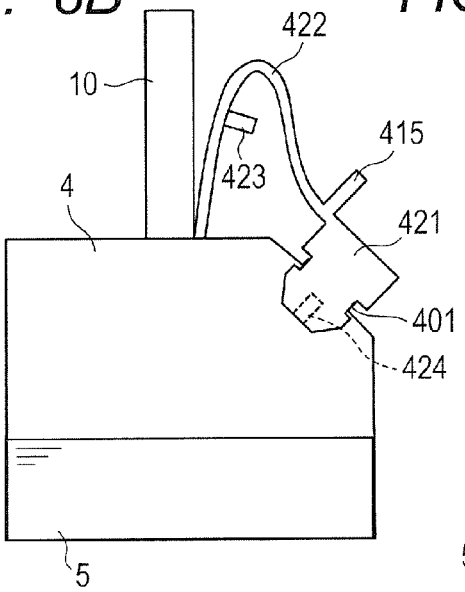
Figure 8C:
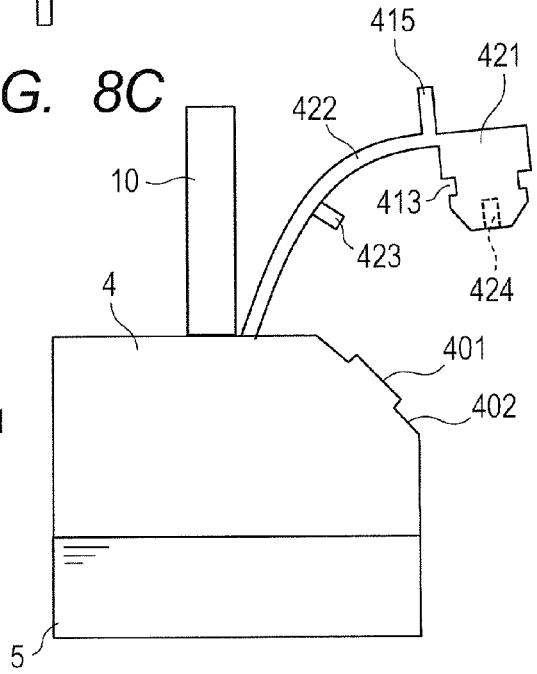
Figure 8D:
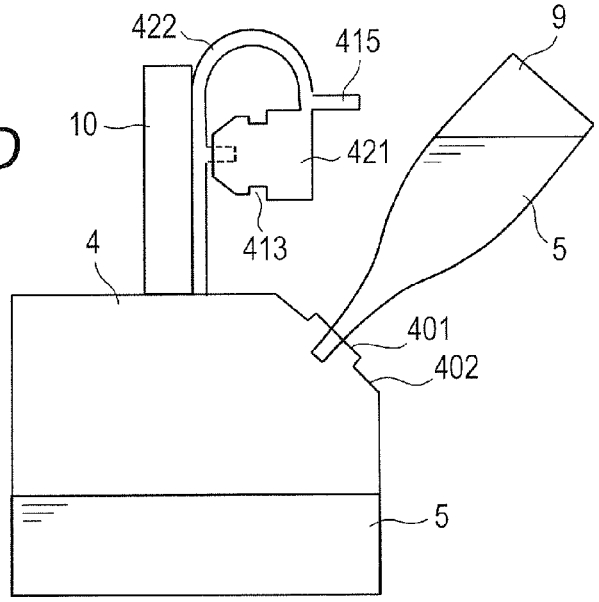

FIG. 8A to FIG. 8D illustrate a liquid storage container unit according to a fifth embodiment. FIG. 8A to FIG. 8D correspond to FIG. 5A to FIG. 5D illustrating the liquid storage container unit according to the second embodiment. In the liquid storage container unit according to the second embodiment illustrated in FIG. 5A to FIG. 5D, to fix the plug 421 to the support member 422, the lug 415 is held and the plug 421 is pressed against the inner side of the support member 422. At this time, however, the support member 422 may deform, reducing the ease of the operation for fitting the recess 424 of the plug 421 onto the protrusion 423 of the support member 422. Therefore, in the liquid storage container unit according to the fifth embodiment, a rigid backup member 10 is disposed on the rear surface side of the support member 422 in the liquid storage container unit of the second embodiment. The backup member 10 is, for example, a prismatic member that extends substantially perpendicularly to the top surface of a liquid storage container 4, and is provided to be in contact with the rear surface of the support member 422 (the surface on the opposite side from an injection port 401). The backup member 10 is adapted to prevent the support member 422 from deforming from the position, at which the support member 422 connects to the liquid storage container 4, in the direction opposite from the injection port 401. The support member 422 comes in contact with the backup member 10 in the second state. The backup member 10 provided enables the plug 421 to be fixed more easily when fixing the plug 421 to the support member 422, since the backup member 10 prevents the support member 422 from deforming backward, as illustrated in FIG. 8D.

Sixth Embodiment

Figure 9A:
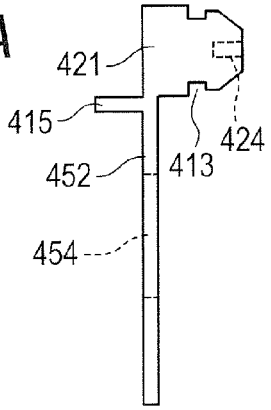
FIGS. 9A, 9B, 9C, 9D, and 9E provide diagrams illustrating a liquid storage container unit according to a sixth embodiment.
Figure 9B:
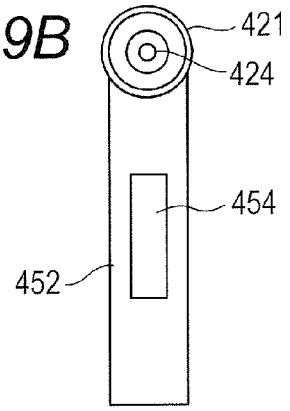
Figure 9C:
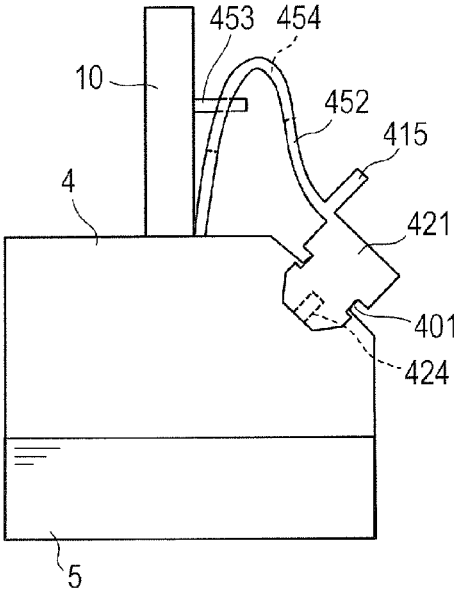
Figure 9D:
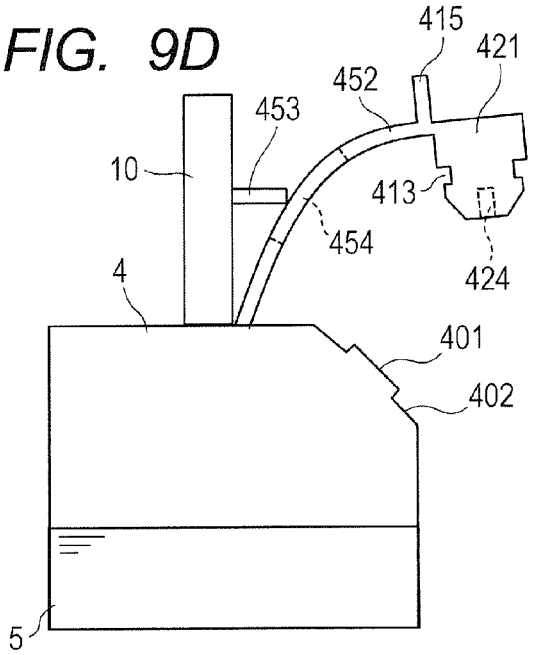
Figure 9E:
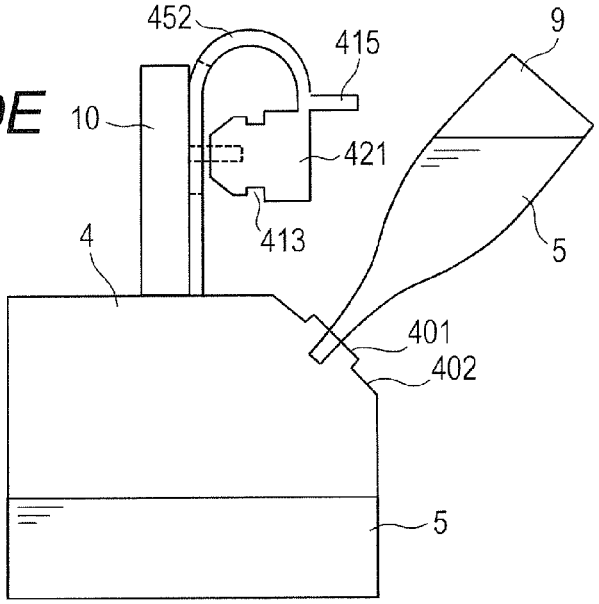
Figure 10A:
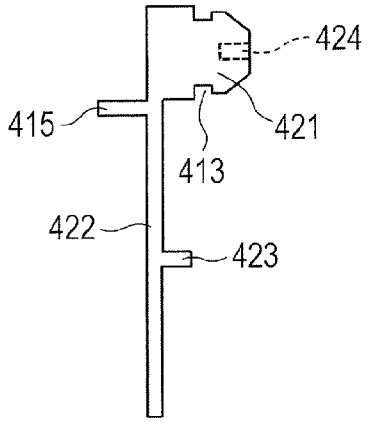
FIGS. 10A, 10B, 10C, and 10D provide diagrams illustrating a liquid storage container unit according to a seventh embodiment.
Figure 10B:
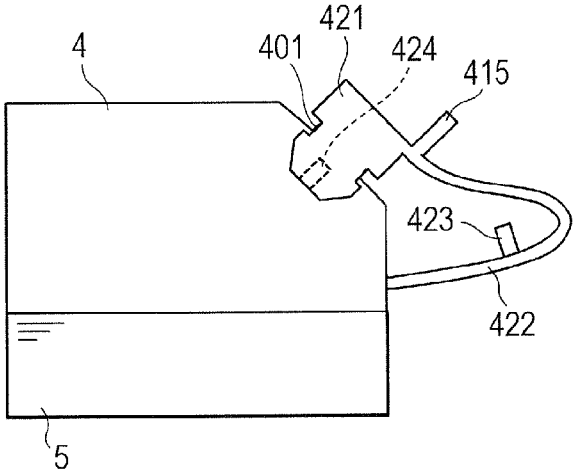
Figure 10C:
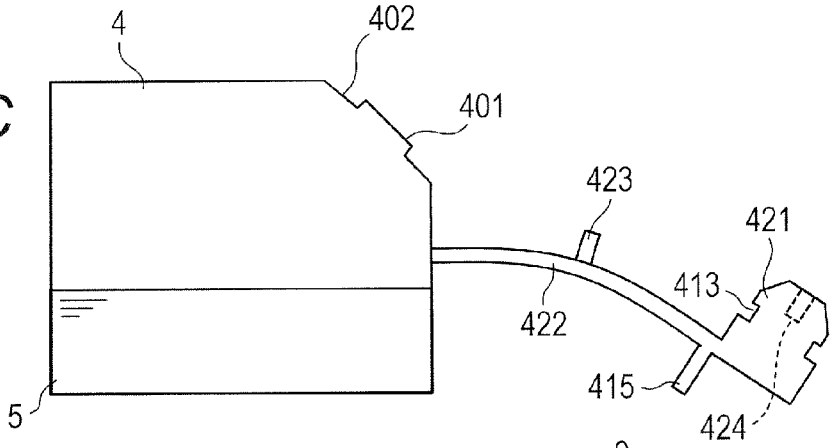
Figure 10D:
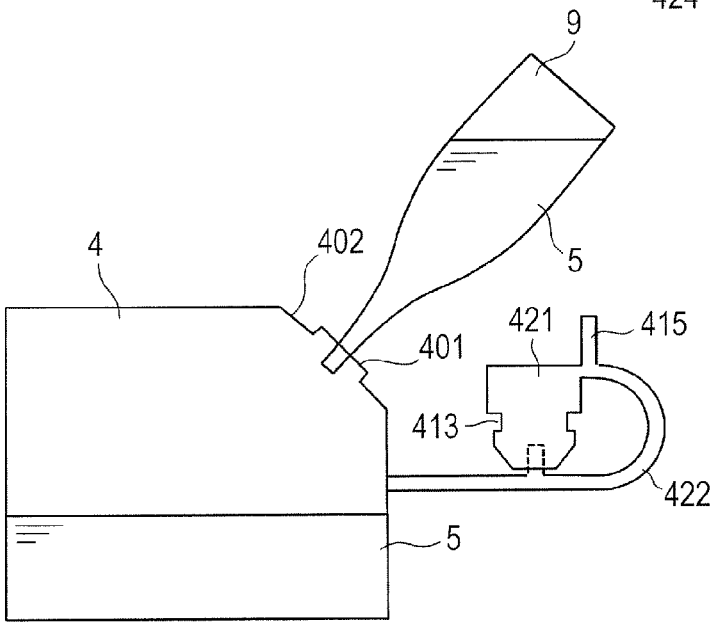

FIG. 9A to FIG. 9E illustrate a liquid storage container unit according to a sixth embodiment. FIG. 9A corresponds to FIG. 5A illustrating the liquid storage container unit according to the second embodiment, FIG. 9B is a front view of a support member 452 and a plug 421 corresponding to FIG. 9A, and FIG. 9C to FIG. 9E correspond to FIG. 5B to FIG. 5D. In the liquid storage container unit according to the sixth embodiment, a protrusion 453 that fits in a recess 424 of the plug 421 is provided on a backup member 10 in place of providing a protrusion on the support member. In other words, the plug 421 is configured to be fixable to a part of the backup member 10, which is a part separate from an injection port 401. Since the protrusion 453 is provided on the backup member 10, the support member 452 integrally molded with the plug 421 has a slit 454 through which the protrusion 453 passes. The slit 454 has a sufficient length along the longitudinal direction of the support member 452 so as not to interfere with the deformation of the support member 452 when the injection port 401 is opened or closed by the plug 421. The present embodiment also prevents the support member 452 from deforming backward when fixing the plug 421 to the support member 452, thus enabling the plug 421 to be fixed with greater ease.

Seventh Embodiment

In the embodiments described above, the position of the fixed end of the support member, which is molded integrally with the plug and which connects the plug to the liquid storage container 4, has been on the top surface of the liquid storage container 4; however, the positional relationship between the position of the fixed end of the support member and the injection port 401 is not limited thereto. In the liquid storage container unit according to a seventh embodiment illustrated in FIG. 10A to FIG. 10D, the same support member 422 and the plug 421 as those shown in the second embodiment are used, but the support member 422 is connected to a liquid storage container 4 at a position on a side surface of the liquid storage container 4 and below an injection port 401. FIG. 10A to FIG. 10D correspond to FIG. 5A to FIG. 5D illustrating the liquid storage container unit according to the second embodiment. The present embodiment also enables the plug 421 to be fixed to the support member 422 with the front edge of the plug 421 facing toward the inner side of the support member 422. This minimizes the possibility of an operator's hand or an infusion container 9 being smeared by a liquid attached to the plug 421 when the injection operation is performed.

Eighth Embodiment

In the first to the seventh embodiments, the front edge of the plug faces toward the inner side of the support member when the plug is detached from the injection port; however, the liquid storage container unit according to the present invention is not limited thereto. For example, even if the front edge of the plug does not face toward the inner side of the support member, the smearing of an operator's hand or the infusion container 9 can be prevented by setting the front edge of the plug closer to the position where the support member and the liquid storage container 4 are connected than to the injection port 401 when the plug is detached. FIG. 11A to FIG. 11D illustrate a liquid storage container unit according to an eighth embodiment. FIG. 11A to FIG. 11D correspond to FIG. 3A to FIG. 3D illustrating the liquid storage container unit according to the first embodiment.

Figure 11A:
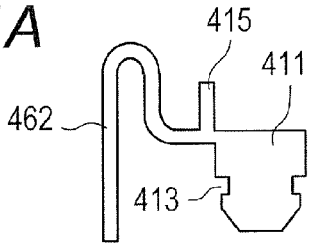
FIGS. 11A, 11B, 11C, and 11D provide diagrams illustrating a liquid storage container unit according to an eighth embodiment.
Figure 11B:
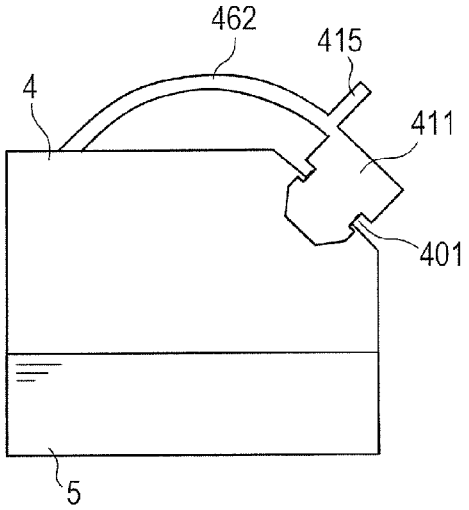
Figure 11C:
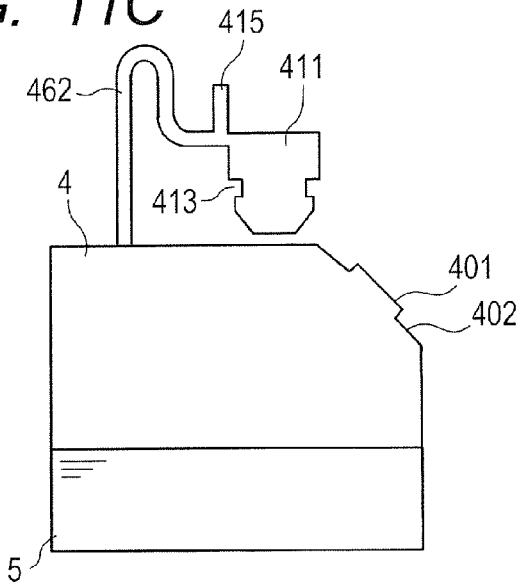
Figure 11D:
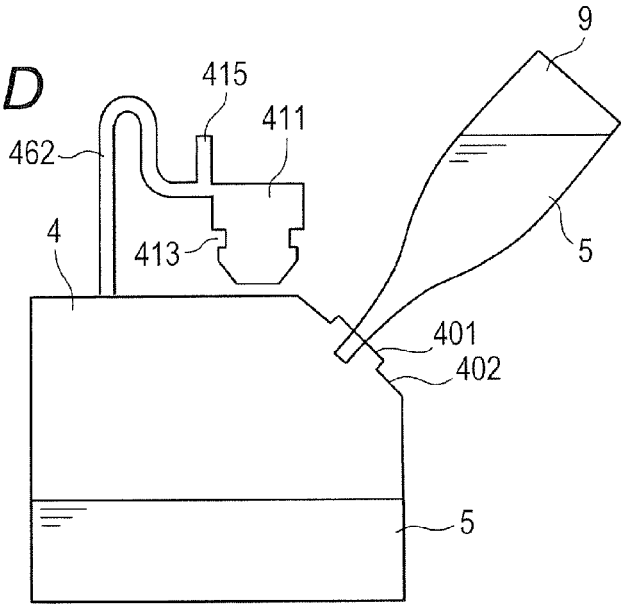

According to the present embodiment, the shape of a support member 462 molded integrally with a plug 411 is devised such that, when the plug 411 is removed from the injection port 401, the plug 411 is positioned adjacently to the center of the top surface of the liquid storage container 4, as observed from the injection port 401. More specifically, in the support member molded like the inverse U shape in the first embodiment, a support member 462 in the present embodiment is obtained by further bending in the horizontal direction one of the two ends of the U shape to which the plug 411 is connected. By using the support member 462 having the folded shape as described above, the front edge of the plug 411 faces toward the top surface of the liquid storage container 4, as illustrated in FIG. 11C, when the plug 411 is removed. When the plug 411 closes the injection port 401, the support member 462 is stretched from its original shape, as illustrated in FIG. 11B. Then, when the plug 411 is removed, the support member 462 regains its original shape, the front edge of the plug 411 approaching the fixed end of the support member 462 on the liquid storage container 4. According to the present embodiment also, the front edge of the plug 411 is not exposed when the plug 411 is removed from the injection port 401, as illustrated in FIG. 11D, thus minimizing the possibility of the smearing of an operator's hand or the infusion container 9 when the injection operation is performed.

In the present embodiment, the front edge of the plug 411, when detached, is not required to always face toward the top surface of the liquid storage container 4, and may more preferably face toward the inner side of the support member, as in the first embodiment. However, it is not necessary to significantly bend the front edge of the plug 411 toward the inner side of the support member as illustrated in FIG. 3A to FIG. 3D, insofar as the front edge of the plug 411 moves close to the fixed end side of the support member 462 from the injection port 401 when the plug 411 is detached. The arrangement for the front edge of the plug 411 to move close to the fixed end of the support member 462 makes it possible to exhibit the effect for minimizing the chance of an operator's hand or the infusion container 9 being smeared when the operation of injecting a liquid 5 is performed.

Ninth Embodiment

Figure 12A:
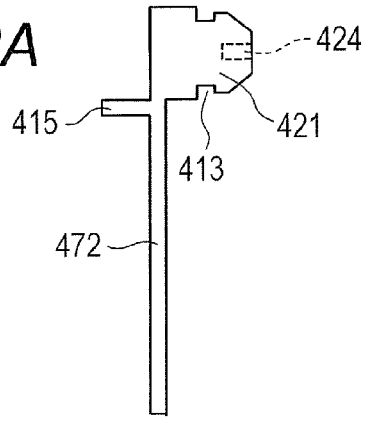
FIGS. 12A, 12B, 12C, and 12D provide diagrams illustrating a liquid storage container unit according to a ninth embodiment.
Figure 12B:
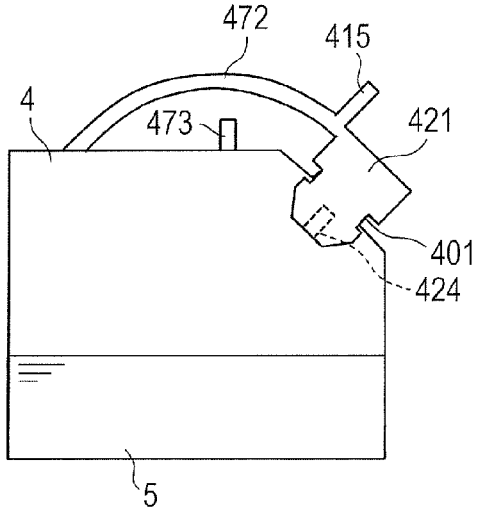
Figure 12C:
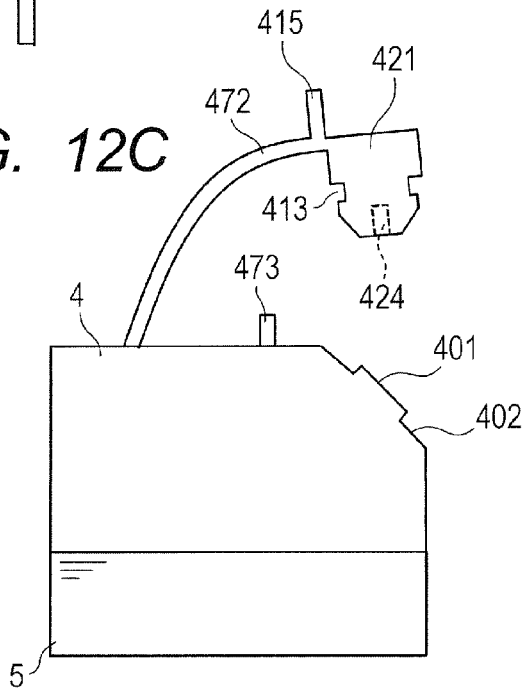
Figure 12D:
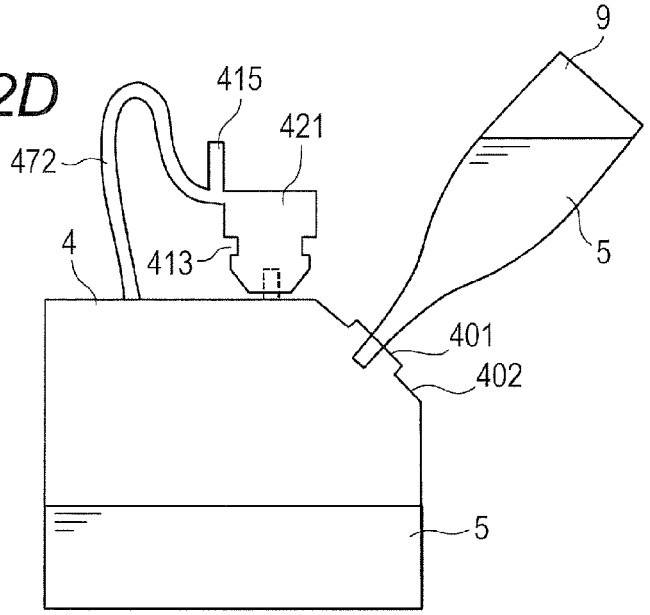

FIG. 12A to FIG. 12D illustrate a liquid storage container unit according to a ninth embodiment. FIG. 12A to FIG. 12D correspond to FIG. 5A to FIG. 5D illustrating the liquid storage container unit according to the second embodiment. In the liquid storage container unit according to the second embodiment illustrated in FIG. 5A to FIG. 5D, the recess 424 of the plug 421 is fitted onto the boss-shaped protrusion 423 provided on the support member 422 to fix the plug 421; however, the structure for fixing the plug 421 is not limited thereto. In the liquid storage container unit according to the ninth embodiment illustrated in FIG. 12A to FIG. 12D, a boss-shaped protrusion 473 to be fitted in a recess 424 provided in the front edge of a plug 421 is formed on the top surface of a liquid storage container 4. A support member 472 which is molded integrally with the plug 421 and which connects the plug 421 to the liquid storage container 4 is not provided with a protrusion that fits in the recess 424. The support member 472 is formed to have a linear shape, as with the second embodiment. In the present embodiment, when the plug 421 is removed from an injection port 401, the recess 424 of the plug 421 is fitted onto the protrusion 473 thereby to enable the plug 421 to be fixed between the injection port 401 and the position of the fixed end of the support member 472, as illustrated in FIG. 12D. The plug 421 is fixed at the position adjacent to the center of the top surface of a liquid storage container 4 as observed from the injection port 401. This makes it possible to prevent the front edge of the plug 421 from being exposed when the plug 421 is removed. Thus, the present embodiment is also capable of preventing an operator's hand or an infusion container 9 from being smeared when the operation for injecting a liquid 5 is performed.

The purport of the present embodiment is to fix the plug 421 between the injection port 401 and the fixed end of the support member 472 while preventing the front edge of the plug 421 from being exposed. Alternatively, therefore, the protrusion may be provided on the plug and the recess may be formed in the top surface of the liquid storage container 4. Further alternatively, a mechanism, such as a hook or a free stop may be used to enable the plug to be fixed rather than by the fitting of the protrusion and the recess. In other words, according to the ninth embodiment, in order to fix the plug to the liquid storage container, a first structure is formed on the front edge of the plug and a second structure is formed on the liquid storage container, and the first structure and the second structure are adapted to be fittable or engageable with each other.

According to the embodiments described above, a liquid storage container unit that minimizes the possibility of smearing an operator's hand or the infusion container 9 when the liquid 5 is injected into the liquid storage container 4 can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-084445, filed Apr. 20, 2016, which is hereby incorporated by reference herein in its entirety.

What is claimed is:

1. A liquid storage container unit comprising:

a liquid storage container provided with an injection port for injecting a liquid therethrough;

a plug which is provided with a front edge for closing the injection port and is attachable to and detachable from the injection port;

a support member which connects the plug and a member other than the plug and elastically supports the plug, wherein the plug takes at least a first state, in which the plug closes the injection port, and a second state, in which the plug opens the injection port and stands by, and the front edge of the plug faces in the direction toward the support member in the second state.

2. The liquid storage container unit according to claim 1, wherein the support member is a molded component which is shaped to have a curved portion and which is configured such that the front edge of the plug faces toward an inner side surface of the curved portion of the support member, with no force being applied.

3. The liquid storage container unit according to claim 1, further comprising:

a first structure formed on the front edge of the plug and a second structure formed on the support member, wherein the first structure and the second structure are engageable with each other to fix the plug in the second state.

4. The liquid storage container unit according to claim 1, further comprising a backup member that comes in contact with the support member from the side of the support member opposite to the side of the support member toward which the front edge of the plug faces in the second state.

5. A liquid storage container unit comprising:

a liquid storage container provided with an injection port for injecting a liquid therethrough;

a plug which is provided with a front edge for closing the injection port and is attachable to and detachable from the injection port;

a support member which connects the plug and a member other than the plug and elastically supports the plug, wherein the plug takes at least a first state, in which the plug closes the injection port, and a second state, in which the plug opens the injection port and stands by, and the front edge of the plug is located between a position at which the support member connects to the other member and the injection port in the second state.

6. The liquid storage container unit according to claim 5, wherein the support member is a molded component which is shaped to have a curved portion and is configured such that the plug is located between the position where the support member connects to the other member and the injection port, with no force is being applied.

7. The liquid storage container unit according to claim 5, further comprising:

a first structure formed on the front edge of the plug and a second structure formed on the other member, wherein the first structure and the second structure are fittable to or engageable with each other to fix the plug in the second state.

8. A liquid storage container unit comprising:

a liquid storage container provided with an opening;

a plug which is attachable to and detachable from the opening and is provided with a front edge to be inserted in the opening;

a support member which connects the plug and a member other than the plug and supports the plug, wherein the support member is formed into a shape having a curved portion, and the front edge of the plug is closer to an inner side surface of the curved portion of the support member in a state in which the plug is removed from the opening than in a state in which the plug is attached to the opening.

9. The liquid storage container unit according to claim 8, wherein in the state in which the plug is removed from the opening, the front edge of the plug faces toward the inner side surface of the support member.

10. The liquid storage container unit according to claim 8, wherein the other member is the liquid storage container.

11. The liquid storage container unit according to claim 8, wherein the plug and the support member are integrally molded.

12. The liquid storage container unit according to claim 8, wherein a supply tube through which a liquid is supplied is connected to a liquid discharge head provided in a liquid discharge device.

13. A liquid storage container unit comprising:

a liquid storage container provided with an opening;

a plug which is attachable to and detachable from the opening and provided with a front edge to be inserted in the opening;

a support member which connects the plug and a member other than the plug and supports the plug, wherein the plug is fixable to a portion other than the opening, and in a state in which the plug is fixed to the other portion, the support member is curved and the front edge of the plug comes closer to an inner side surface of a curved portion of the support member than in a state in which the plug is attached to the opening.

14. The liquid storage container unit according to claim 13, further comprising a backup member that comes in contact with a surface opposite to the inner side surface of the support member.

15. The liquid storage container unit according to claim 14, wherein the other portion is a part of the backup member.

16. The liquid storage container unit according to claim 13, wherein the other portion is a part of the inner side surface of the support member.

17. The liquid storage container unit according to claim 13, wherein in a state in which the plug is fixed to the other portion, the front edge of the plug faces toward the inner side surface of the support member.

* * * * *